US005373613A

United States Patent [19]

Young, Jr. et al.

[11] Patent Number: 5,373,613

[45] Date of Patent: Dec. 20, 1994

[54] TENTER FRAME WITH PINNED ROLL TRANSFER MEANS

[75] Inventors: William O. Young, Jr., Spartanburg; Dennis W. Cothran, Pacolet, both of S.C.

[73] Assignee: Young Engineering, Inc., Spartanburg, S.C.

[21] Appl. No.: 966,137

[22] Filed: Oct. 23, 1992

[51] Int. Cl.[5] ..... D06C 3/02

[52] U.S. Cl. ..... 26/96; 26/7; 26/86

[58] Field of Search ..... 26/7, 10.4, 51, 71, 26/86, 89, 96, 98, 88, DIG. 1

[56] References Cited

U.S. PATENT DOCUMENTS

| | | | |
|---|---|---|---|
| 1,697,828 | 1/1929 | Cunniff | 26/10.4 |
| 1,773,232 | 8/1930 | Lenders | 26/86 |
| 1,880,487 | 10/1932 | Richardson | 26/10.4 |
| 2,907,195 | 10/1959 | Schoenster et al. | 26/96 |
| 2,916,899 | 12/1959 | Hepp et al. | 26/96 |
| 3,031,732 | 5/1962 | Carlisle | 26/96 |
| 3,224,313 | 12/1965 | Mohring | 26/96 |
| 3,900,141 | 8/1975 | Duckworth | 26/86 |
| 3,936,915 | 2/1976 | Becker | 26/86 |
| 5,042,121 | 8/1991 | Young, Jr. | 26/86 |

FOREIGN PATENT DOCUMENTS

| | | | |
|---|---|---|---|
| 2539421 | 3/1977 | Germany | 26/86 |
| 8412240 | 7/1984 | Germany . | |

*Primary Examiner*—Clifford D. Crowder
*Assistant Examiner*—Amy B. Vanatta
*Attorney, Agent, or Firm*—Dority & Manning

[57] ABSTRACT

The invention relates to a tenter frame for treating web materials such as woven or knitted fabrics, film or the like, to apparatus for removing a web from a tenter while controlling the web and to a process for removal of a web from a tenter. A pair of endless opposed tenter chains having a plurality of pins thereon engage opposite edges of the web material for holding it as it is treated on the tenter frame. Pinned rolls are provided for engaging and transferring the web material from the pins of the tenter frame with the web taken off of the tenter chains without loss of control over the web. A cutter unit is also provided for trimming the edges from the web after it has been removed from the tenter chain, and while the web remains under control of the pinned rolls, after which trimmed edges are automatically removed from the pins for discarding.

8 Claims, 9 Drawing Sheets

TENTER FRAME WITH PINNED ROLL TRANSFER MEANS

BACKGROUND OF THE INVENTION

This invention relates to a tenter frame for treating web materials such as knitted fabrics, woven fabrics, felted fabrics, or the like, to apparatus for use in conjunction with a tenter frame, and to methods for use of same. More particularly, the present invention is directed to a tenter frame equipped with improved means for removing a web being processed on the tenter without loss of control over the web, to the removal means per se and to improved methods of removal of webs from tenters.

In the general operation of tenter frames, a web material enters the machine at one end where the web is engaged along its edges or selvages by a series of upwardly extending pins which penetrate the web material. The pins are, in turn, secured to and supported by two endless tenter chains. The web material is thus held along its opposite edges by the upwardly extending pins for the full period of web travel through the tenter frame where it may be subjected to various and sundry treatments. For example, where the web material is a knitted or woven fabric, it may simply be washed, shrunk or stretched as desired and maintained in a desired dimensional state by the tenter chains as it dryed. In any event as web material moves through the tenter frame and reaches the exit end it becomes necessary to remove the web from the pins on the tenter chains for ultimate removal of the web from the tenter. At the same time in processing many web materials, it is necessary to trim the edges or selvages of the web material to remove the portion which has been penetrated by the pins on the tenter chains. Otherwise a defect may be created in the web. Other webs, however, are unaffected by the pin holes and no trimming is necessary.

One prior art arrangement for web removal from a tenter frame is illustrated in FIG. 1. In FIG. 1, a tenter frame generally 10 is shown schematically, including a portion of a tenter chain 12 with a plurality of upward extending tenter pins 14. In tenters of this type, the frame is provided with a pair of tenter chains but only one is illustrated in FIG. 1 for purposes of clarity. A fabric F is pinned by pins 14 along opposite selvages and the chains are moved inwardly or outwardly with respect to each other to achieve a predetermined fabric width. At an exit end of tenter 10, fabric F is entrained about a pinned take-off roll 16 which is spaced from tenter pins 14 and is intended to engage (pin) the edges of the web material before it is disengaged from tenter pins 14. Fabric F is then entrained about a second pinned cutter support-roll 20 spaced from roll 16 where the edge is trimmed from the fabric by a cutter blade 18, with the selvage S being separated from the fabric F as illustrated, as by way of suction.

One problem with the arrangement of FIG. 1 follows. Web entering tenter frames sometimes escapes becoming pinned along short portions of same. At such unpinned areas, the web which is under tension necks in towards the center of the tenter and away from the pins. Consequently, at the exit end of the tenter, the necked-in portion of the web may not make contact with pins on roll 16, or roll 20. Consequently, once the previously removed selvage is cut by element 18, a new trimmed end is produced which is not removed by suction or the like, leaving the remainder of web F on the tenter pins which continues to build up around roll 20 and eventually disrupts tenter operation, not to mention defects produced in web F. Also, control of web F is lost in the space between rolls 16 and 20.

A second prior art arrangement is illustrated in FIG. 2 of the drawing. A single pin-cutter support roll 20 functions as the guide roll for pinning web F before it is disengaged from the tenter pins 14. Selvage S is trimmed from the web F by a cutter 18 which operates in conjunction with pinned roll 20. Again, the same problems as noted above are present, in that portions of web F are free of pins 14 before being picked up by pinned roll 20 and define necked-in portions, wherefore control over web F is lost. In this arrangement, cutter 18 would also create a new leading edge at the necked-in portion and the trimmed web would build up around roll 20. Prior art arrangements of FIGS. 1 and 2 are generally typical of the known prior art in that both fail to exert positive control over the web material before its removal from the tenter chain pins.

The present invention overcomes the problems noted above. Particularly, prior to disengagement from tenter pins 14, the web is pinned by a pinned removal roll. Removal pinning occurs inside the conveyor pin line and thus minimizes missing of small web sections. Also even if a small section is missed, apparatus according to the present invention automatically releases the pinned waste which will permit a new leading edge of waste to be removed. Consequently, the web waste will not continue around any roll or conveyor and create problems for the tenter.

In addition to the above, the present invention permits accurate web trimming. Such results in substantial savings over conventional methods. Though web widths of only one-quarter inch or so may be involved, significant amounts of web can be wasted during continuous running of a tenter. The present invention thus represents significant improvement over known prior art.

SUMMARY OF THE INVENTION

It is an object of the invention to provide a tenter frame which is equipped with apparatus for positively controlling and transferring the edges of web material from the pins of the tenter chains onto the pins of the guide roll.

It is yet another object of the invention to provide a tenter frame with apparatus for positively controlling the removal of web material from the tenter pins for trimming or other processing, and where pinning the web for removal occurs prior to release from the tenter pins.

Another object of the present invention is to provide apparatus for use with a tenter frame for enhanced web removal from the tenter followed by accurate trimming of waste from the web and automatic unpinning of the waste for removal.

Still another object of the present invention is to provide apparatus for removing a web such as a fabric from a tenter frame without loss of width control of the web, followed by enhanced trimming and waste removal.

Yet another object of the present invention is to provide apparatus for removal of a web from a processing machine on which the web is pinned, and trimming the web while maintaining width control of the web as was maintained on the machine, and removal of the trimmed waste.

Another object of the present invention is to provide an improved process for removal of a web from a tenter frame.

Yet another object of the present invention is to provide an improved process for removing a web from a tenter frame and trimming waste along the selvages while maintaining width control of the web as was maintained on the tenter.

These objects and others which will become obvious during the description of the invention are attained by a tenter frame which comprises a pair of endless opposed tenter chains, each of which has a plurality of upwardly extending pins for engaging and holding opposite edges of web material. Means are included for supporting and guiding the tenter chains for movement along the tenter frame for transporting the web material as it is being treated in the tenter frame from one end of the tenter frame to the other. A pair of pinned removal rolls are provided, one of which is disposed adjacent the pins on each of the tenter chains and having a plurality of outwardly extending pins which engage the web adjacent the upwardly extending pins on the tenter chains at a web disengaging point adjacent the other or exit end of the tenter frame. Pins extending from the removal rolls penetrate edges of the web material before it is disengaged from the tenter pins. Disposed on the other side of the web material opposite each of the pinned guide rolls may be a rotary brush having a plurality of bristles for pressing the web material further onto the pins of the pinned removal roll for disengaging the web material from the tenter chains. The web material is then guided about a portion of the periphery of the pinned guide roll to a point where it is trimmed and thereafter the trimmed edges are automatically unpinned and removed.

BRIEF DESCRIPTION OF THE DRAWINGS

The invention will now be described in conjunction with the accompanying drawings, in which.

DESCRIPTION OF PREFERRED EMBODIMENTS

As generally set forth above, webs being processed through a tenter frame according to the present invention are removed while maintaining total control over the web before release of the web from the tenter pins and throughout a trimming operation. Such continuous control over the web leads to improved operation by way of tenter operation and reduction of waste produced when trimming the web, if necessary. Thereafter, trimmed waste is automatically unpinned for removal.

Figure 1:
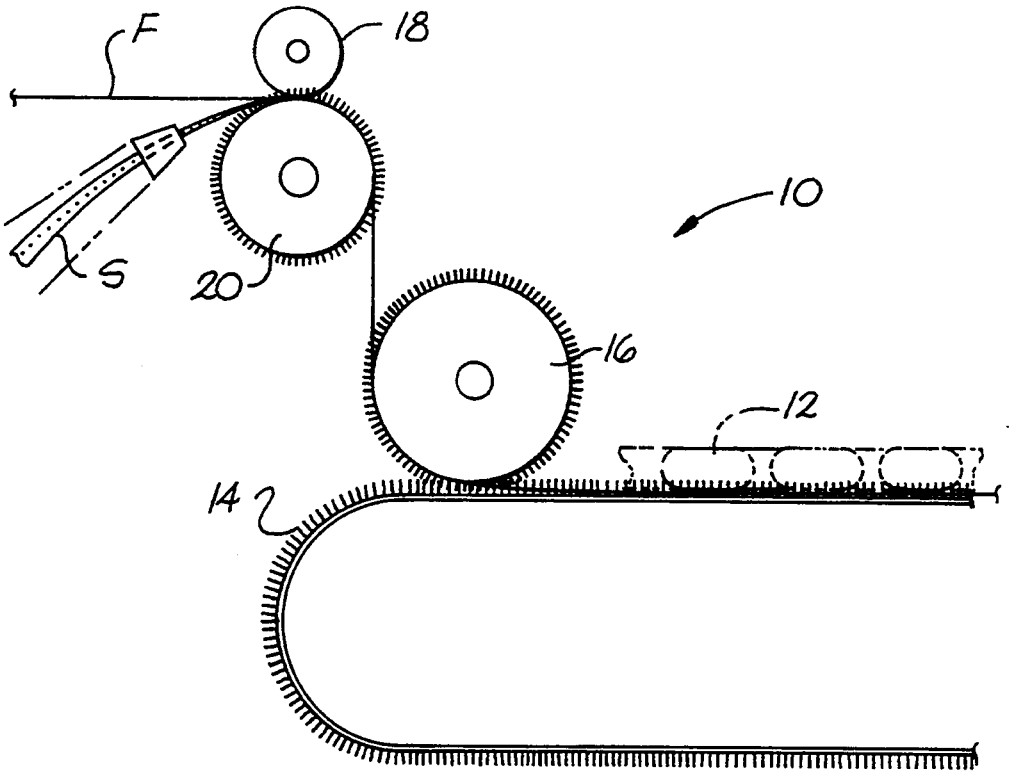
PRIOR ART Fig. 1
FIG. 1 is a side schematic view of a prior art arrangement for removing web materials from a tenter frame.
Figure 2:
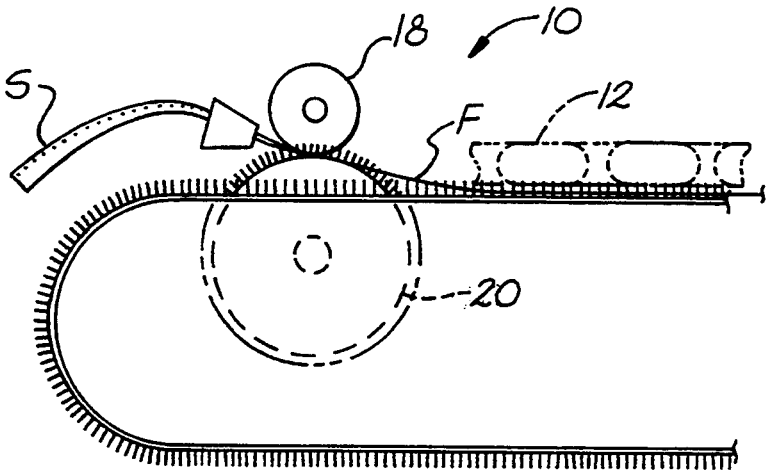
PRIOR ART Fig. 2
FIG. 2 is a schematic side view of a second prior art arrangement for removing web material from the pins of a tenter chain.

FIGS. 1 and 2 as noted above illustrate schematic views of prior art arrangements for removal of webs from tenter frames. As can be readily seen, both provide a pinned roll 16, 20 for lifting a web F from the tenter pins 14. Both, however, are fraught with the problem of total control of the web during removal and trimming. Likewise, if an unpinned portion occurs, upon trimming, a new leading edge is created when the cutter runs into the necked-in gap. The new leading edge thus remains on the respective roll and continues to build up until operational problems occur.

The present invention overcomes the above problems due to continuous control over the web, improved trimming procedures, and automatic unpinning of trimmed waste. A more efficient and improved operation results as well as a realization of economy of web cost.

Figure 3:
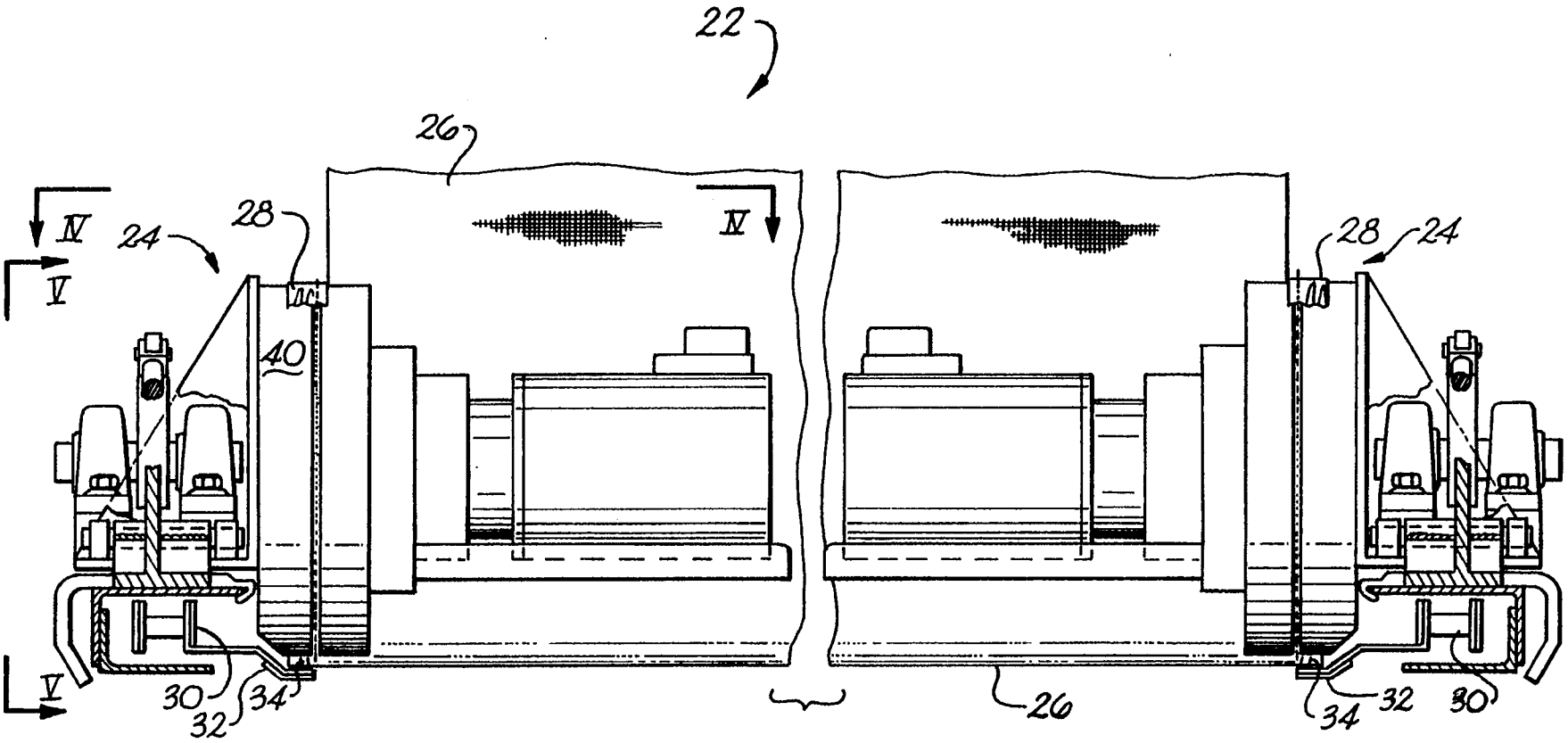
FIG. 3 is an view of a portion of an end of a tenter frame looking from inside the tenter, with parts broken away for clarity and other parts shown in section and which illustrates the present invention.

Referring now to FIGS. 3–11 of the drawings, preferred embodiments of the present invention will be described. In FIG. 3, there is illustrated a tenter frame generally 22 according to the present invention. Tenter frame 22 is similarly equipped as those of FIGS. 1 and 2 with two units generally 24 (one adjacent each tenter chain 30) for disengaging and removing a fabric or other web 26 from tenter chains 30. Endless tenter chains 30 hold a selvage or edge 28 of each side of web material 26 by a series or plurality of tenter pins 34 extending upwardly from portion 32 of tenter chains 30. Tenter chains 30 are guided along each side of the tenter frame 22 and are intended to maintain a web 26 in a predetermined tension condition and at a predetermined width as it is fed from one end of the tenter frame to the other. The web disengaging units 24 are the same on each side of the tenter frame except that the one on the right hand side is a mirror image of the one on the left in its relationship to web 26. For sake of clarity, hereinafter the structure of the left web removal unit 24 will now be described in detail.

Figure 4:
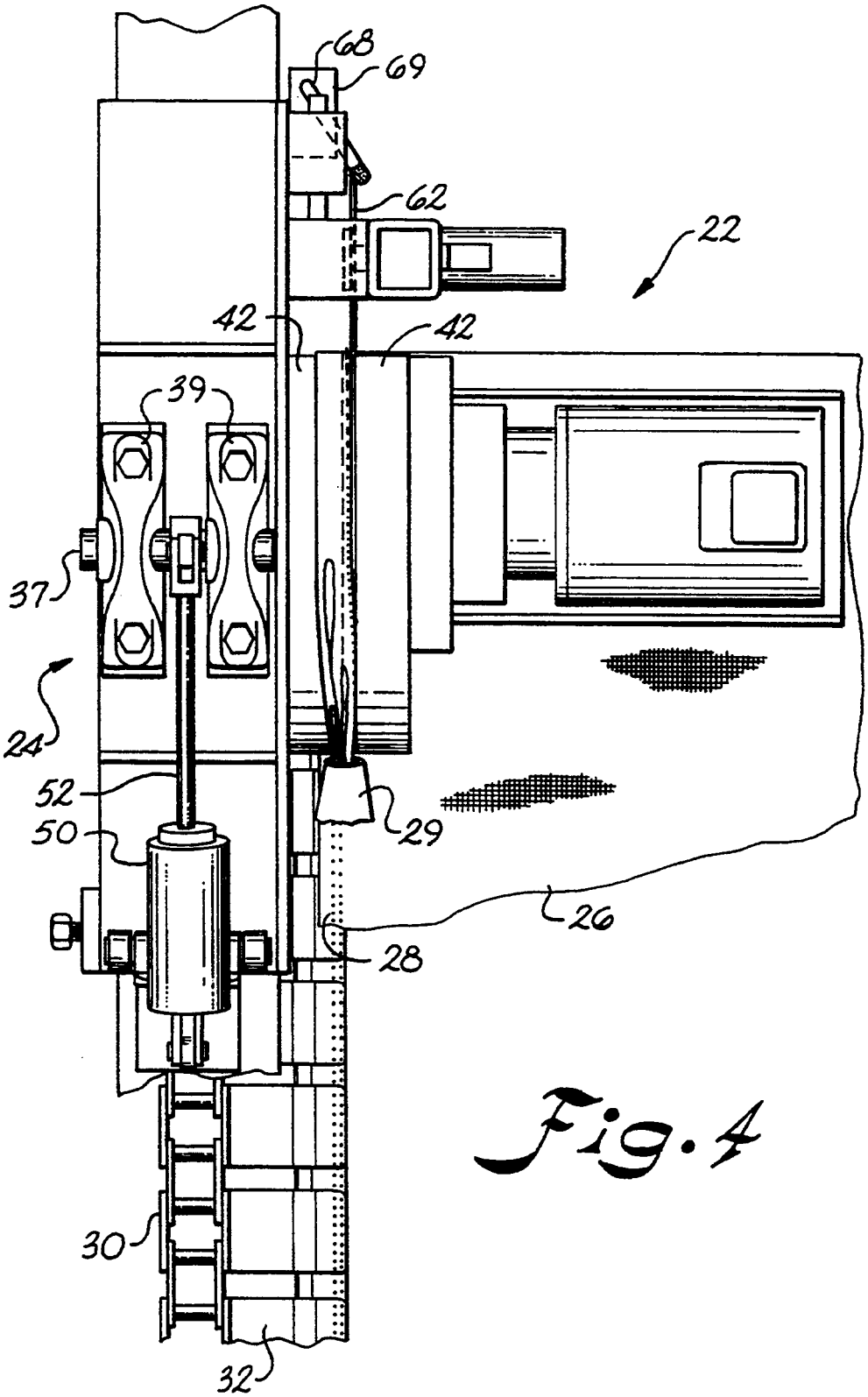
FIG. 4 is a top view of a portion of the tenter frame of FIG. 3 taken along lines IV—IV of FIG. 3.
Figure 5:
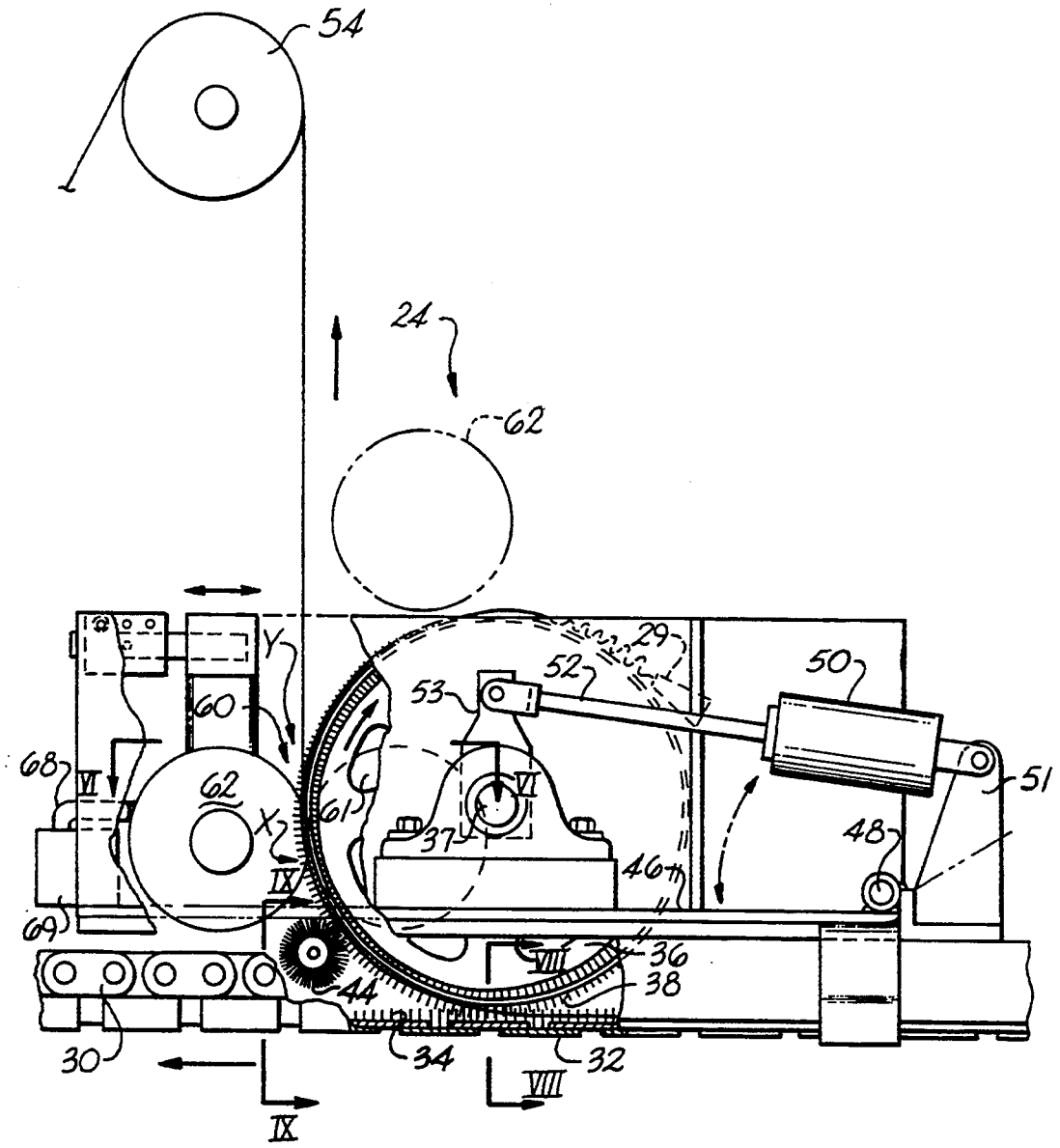
FIG. 5 is an enlarged side view of apparatus according to the present invention, with parts broken away for clarity and part of which is taken generally along line V—V of FIG. 3.
Figure 10:
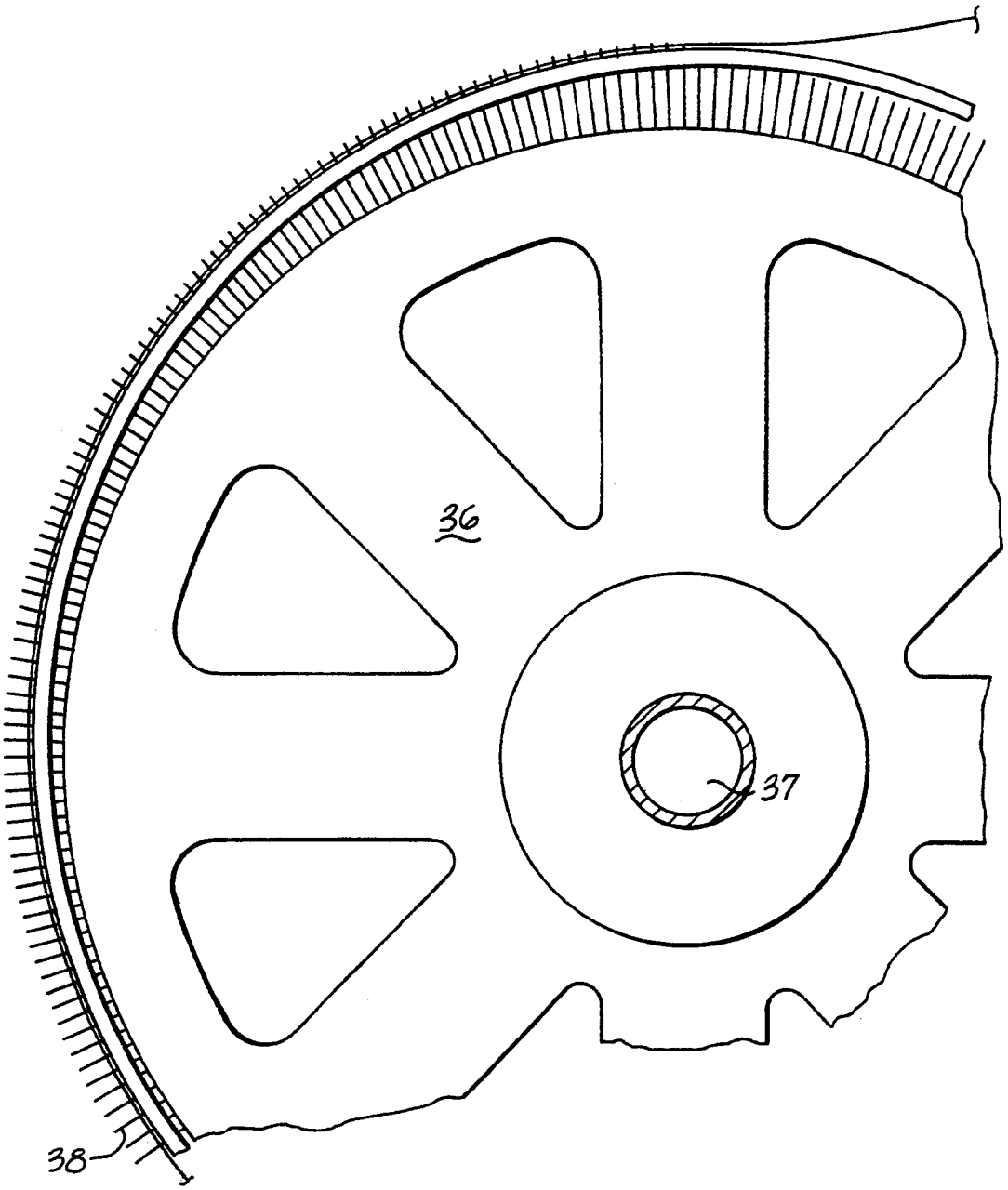
FIG. 10 is an enlarged partial view of the pinned roll according to the present invention with web material guided thereabout.

In FIGS. 4, 5 and 10 of the drawings, a preferred embodiment of unit 24 is illustrated in detail. As best seen in FIG. 5, web material 26 is held by a series of tenter pins 34 each extending through the edge or selvage 28 of web 26. Such a pinned arrangement is provided throughout the length of the tenter. Conveyor speeds may also be adjusted relative to each other for purposes well known to those skilled in the art. At the web disengaging area located adjacent an exit end of the tenter, pins 38 of removal roll 36 penetrate the web 26 while web 26 is still retained by pins 34 on the tenter chain. Unit 24 is located with respect to tenter conveyor 30 so that pins 38 penetrate web 26 along a line inside (toward the opposite edge of web 26) the line of tenter pins 34, and closely proximate thereto (see FIG. 8).

As best shown in FIG. 5, pinned removal roll 36 is secured to a shaft 37 which is supported for free rotation by a pair of pillow block bearings 39, both of which are secured to unit base 46. A housing 40 is located on base 46 and is received about guide roll 36 with a slot 41 being defined thereby in line with pins 38, and with circumferential surfaces 42 located on opposite sides of slot 41. Roll 36, however, is eccentric within housing 40, with pins 38 extending through slot 41 and beyond housing 40 about only a portion of its periphery and with pins 38 receding within housing 40 about another portion of the periphery of roll 38, the purpose of which will be described hereinafter. Housing 40 in a preferred arrangement is fixed though, if desired, could be constructed to rotate.

Referring to FIG. 5, it can be seen that pins 38 extend from housing 40 about a lower portion of housing 40 where pins 38 penetrate web 26. Thereafter, during clockwise movement of removal roll 36, at some point about an upper portion of housing 40, the eccentricity of roll 36 with respect to housing 40 causes pins 38 to move relatively inwardly with respect to housing 40, and with surfaces 42 forcing web portion 26 off pins 28. Thereafter, the released portion of web 26 moves away from housing 40 as described hereinafter.

Figure 6:
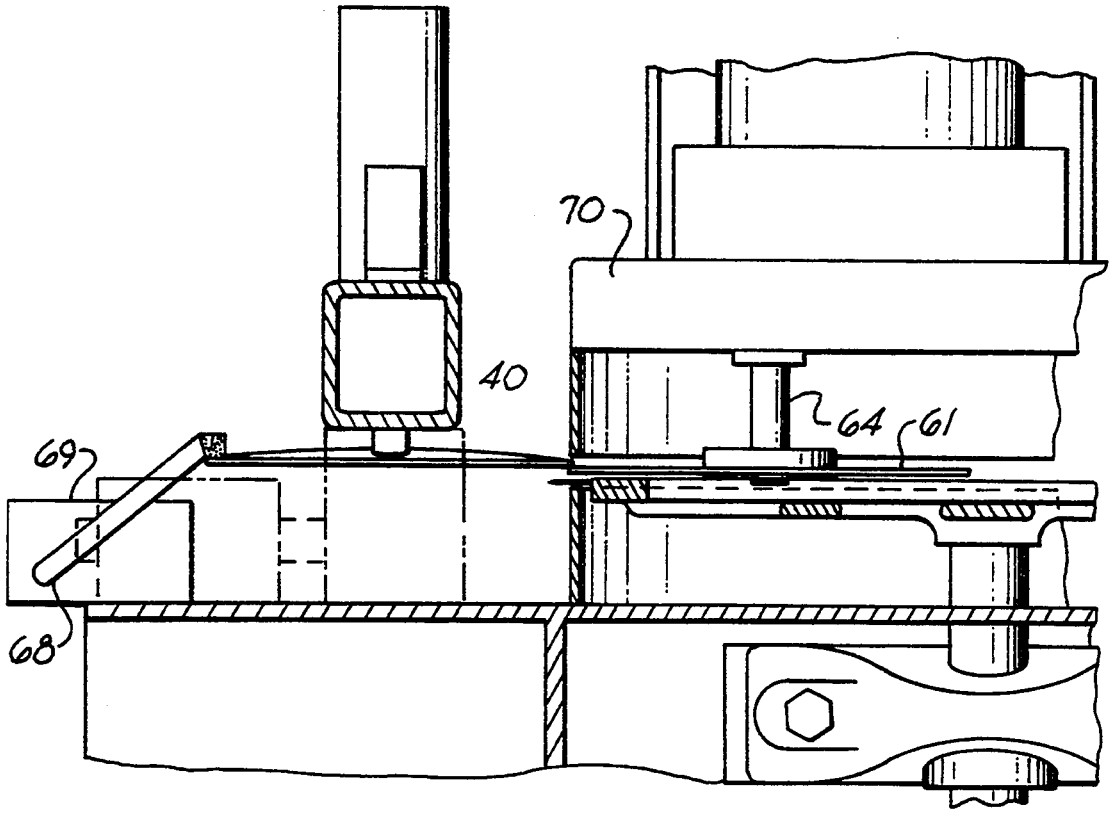
FIG. 6 is a sectional view taken along line VI—VI of FIG. 5 illustrating preferred cutting apparatus according to the present invention.
Figure 7:
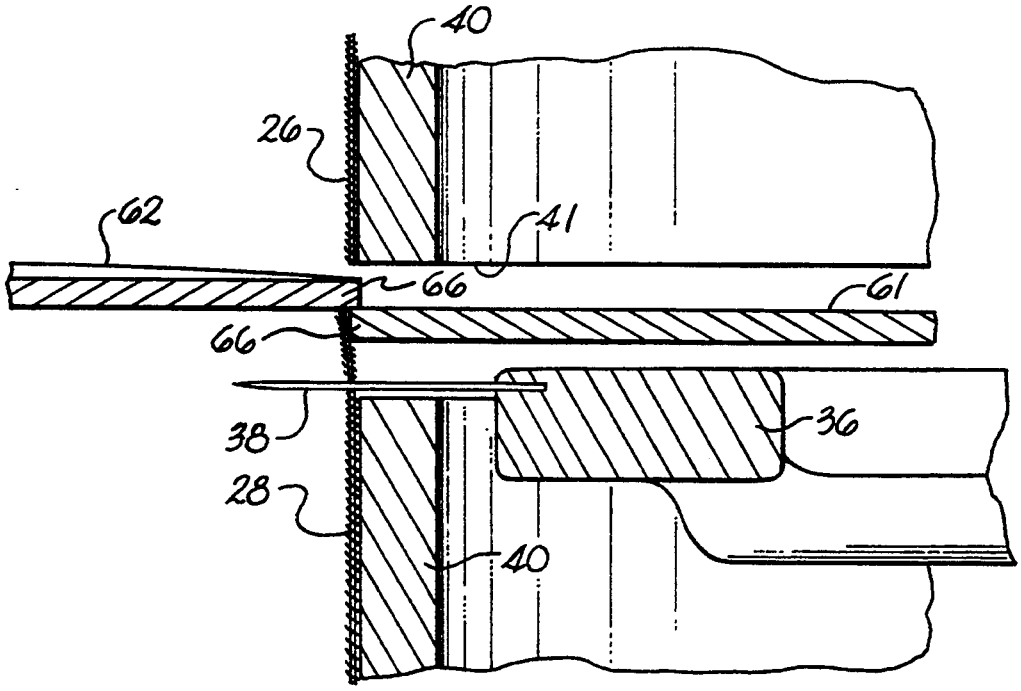
FIG. 7 is an enlarged view of a portion of the cutting apparatus illustrated in FIG. 6.

FIGS. 5, 6 and 7, illustrate a preferred cutter unit generally 60 which includes a driven cutting blade 61 mounted within housing 40 and an idler cutting blade 62 mounted a shaft 64 outside housing 40. Blades 61 and 62 cooperate as defined hereinafter in the path of travel of web 26 about housing 40 to sever the edge or selvage of web 26 adjacent pinned guide roll 38, and while web 26 remains under the control of roll 36. The cutting unit will be described in more detail hereinafter.

Figure 9:
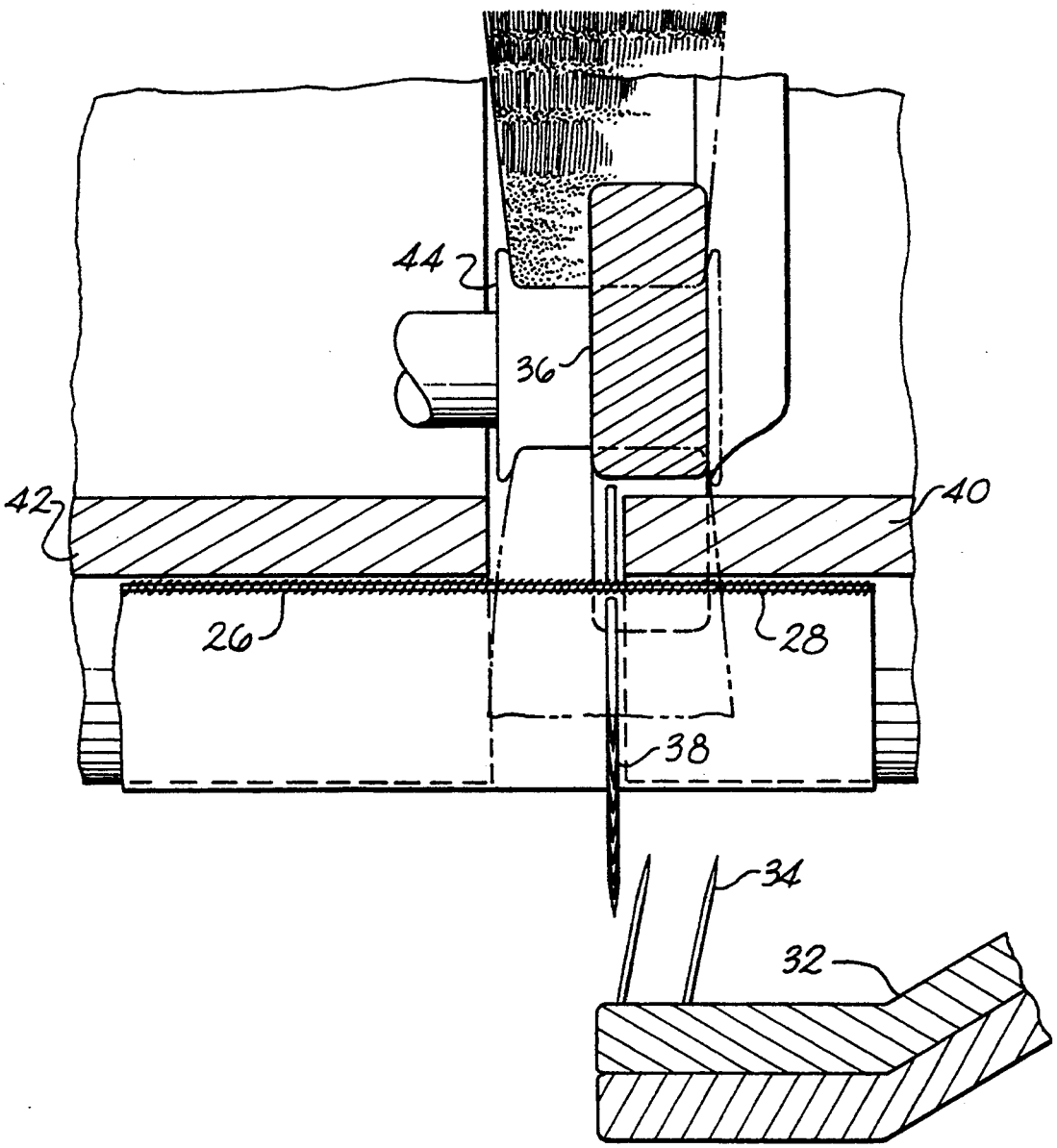
FIG. 9 is a view similar to FIG. 8 illustrating the completed disengagement of the web material from the tenter chain pins by apparatus according to the present invention.

Disposed beneath housing 40 and web 26 is a brush roll 44, the bristles of which press web 26 more fully onto the outwardly extending pins 38 of the pinned removal roll 36 after web 26 is picked up thereby as seen in FIG. 5. Brush 44 thus assures a positive placement of web 26 onto pins 38 of roll 36 as best seen in FIGS. 5 and 9 of the Figures.

Referring now more particularly to FIGS. 6 and 7 of the drawings, details of the cutting unit 60 is shown. Cutting blade 61 is rigidly mounted onto a shaft 64 which is mounted in suitable bearings and which is driven by a drive means 70 within housing 40. As best seen in FIG. 7, a square cutting edge 66 of cutting blade 61 extends through slot 41 of housing 40 into the path of web 26. Cutting blade 62 is mounted on a fixed axis for free rotation, and is spring-loaded and skewered at a slight angle to shaft 64 on which blade 61 is mounted to permit the square edges of blades 61 and 62 to overlap in surface engaging fashion as seen in FIG. 7. Preferably an overlap of 0.063 inch is achieved. Blades 61 and 62 are arranged so that a gap of from about 0.002 inch to about 0.005 inch, and most preferably 0.003 inch is present at the exit end of the overlap (Y in FIG. 5) while touching at an entrance to the overlap (X in FIG. 5). In other words, a scissors-type action occurs at the entrance X of the blade overlap with the exit gap providing an appropriate blade relationship. Moreover, since metal-to-metal contact occurs between cutting blades 61 and 62, dulling of the blades has been commonplace in such a cutter arrangement, particularly when no web is passing thereby. The above preferred arrangement lessens significantly the dulling of the blades. Also to further facilitate the lessening of blade dulling, a small amount of a lubricant is applied to the overlapping portion of blade 62 by wiping contact from a lubricant applicator 68 which obtains lubricant from a reservoir 69. (see FIGS. 5 and 6). Though the above-described cutter arrangement is preferred, other cutters such as conventional high speed rotary blade cutters may also be employed.

As best seen in FIGS. 5 and 10, as web 26 moves about housing 40 engaged by pins 38, web 26 moves through cutter 60 where the selvage 28, now on pins 38 is cut very close to the pin line. After cutting or trimming, trimmed web 26 moves upwardly along a path to roll 54 which may be a torque driven roll or an idler roll. Trimmed selvage 28 remains on pins 38 and continues to move about the outer surface of housing 40. Eccentricity of roll 36 with respect to housing 40 causes pins 38 to move relatively inwardly with adjacent housing surfaces 42 holding selvage 28. At a point about a top portion of housing 40 as viewed in FIG. 5, selvage 28 is released from pins 38 and begins to accumulate along a downward slope of housing 40. Waste selvage 28 can now be removed as by way of a suction arrangement illustrated at 29, though other arrangements such as conveyors, wind-up rolls or the like may also be employed. Suction system 29 may be operated by a regenerative blower (not shown), and the output side of the blower may be connected to housing 40 to supply air thereto for maintenance of a positive pressure within housing 40. Such positive air pressure within housing 40 precludes or lessens the introduction of lint from the trimming operation into housing 40.

Figure 8:
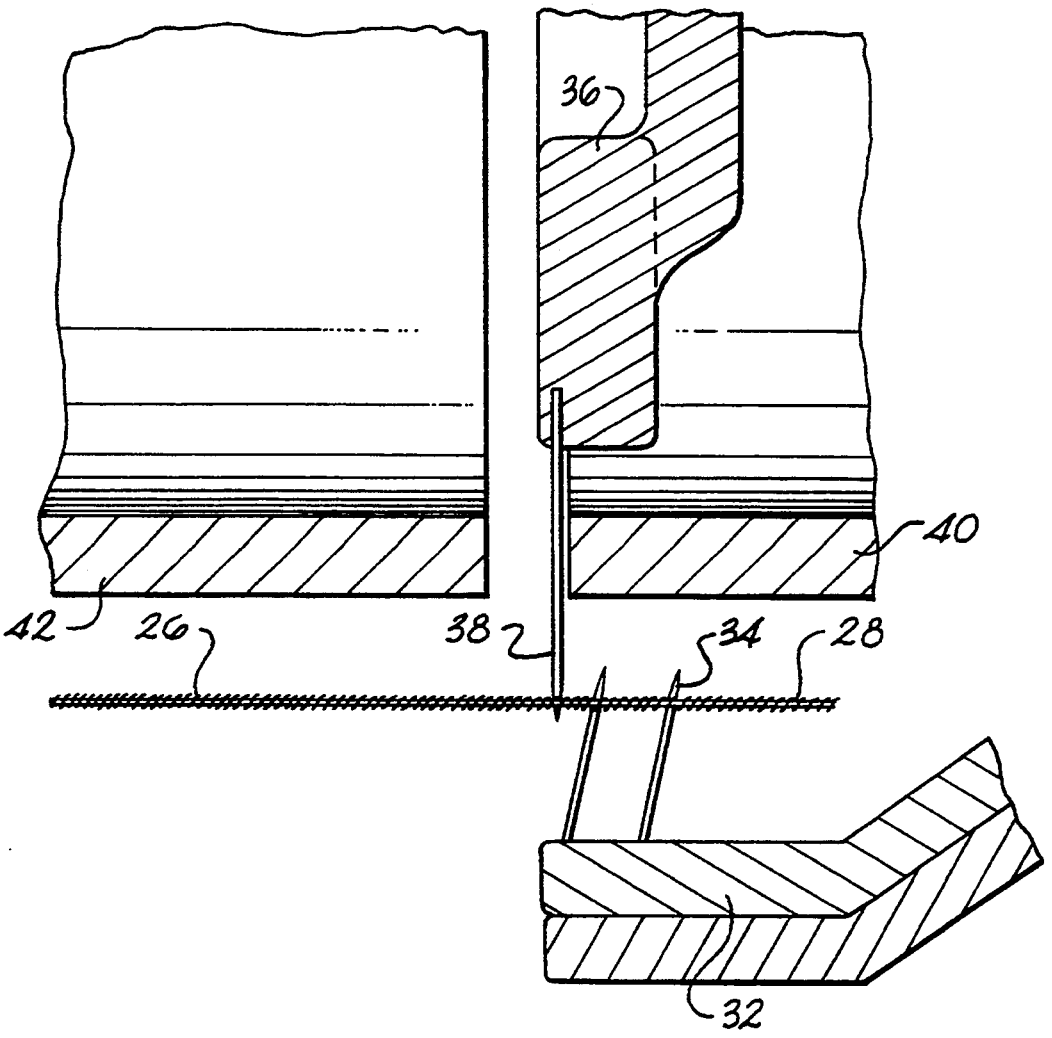
FIG. 8 is an enlarged sectional view illustrating the initial penetration of the web material by the pins of removal apparatus according to the present invention the web remains pinned by the tenter chain pins.

In FIG. 8 it will be seen that pins 34 on tenter portion 32 extend through edge or selvage 28 of web 26 at a slight angle which assists in maintaining tension on web 26. At the point where pins 38 of the pinned removal roll 36 begin to penetrate web 26 such angular relationship assists pins 38 since tension is maintained on web 26 thereat. FIG. 9 illustrates a point after pins 38 have penetrated web 26 and web 26 is being forced more fully onto pins 38 of pinned removal roll 36 by brush 44. At this point, web 26 has been removed from tenter chain pins 34 without any chance of control of the edge or selvage 28 being lost. Such permits a positive trimming of the web at a point very close to edge or selvage 28 without undue waste of the material.

Referring again to FIGS. 4 and 5, it will be noted again that pinned removal roll 36 is supported by pillow block bearings 39 for rotation about an axis 37. Bearings 39 are secured to unit support 46 which is mounted to pivot about pivot point 48. A fluid cylinder 50 is supported on a bracket 51 with rod 52 pivotally connected to a support bracket 53 located between bearings 39. Actuation of cylinder 50 in a known manner causes rod 52 to move inwardly of cylinder 50 which causes housing 40 and cutting means 60 to rotate upwardly about shaft 37 to broken line position as shown in FIG. 5. Cutting means 60 are thus moved upwardly and away from the path of web travel. In such disposition, the path of travel of web 26 is redefined and permits release of web 26 due to the eccentricity of roll 36 with respect to housing 40 without trimming as is desired for some webs.

Figure 11:
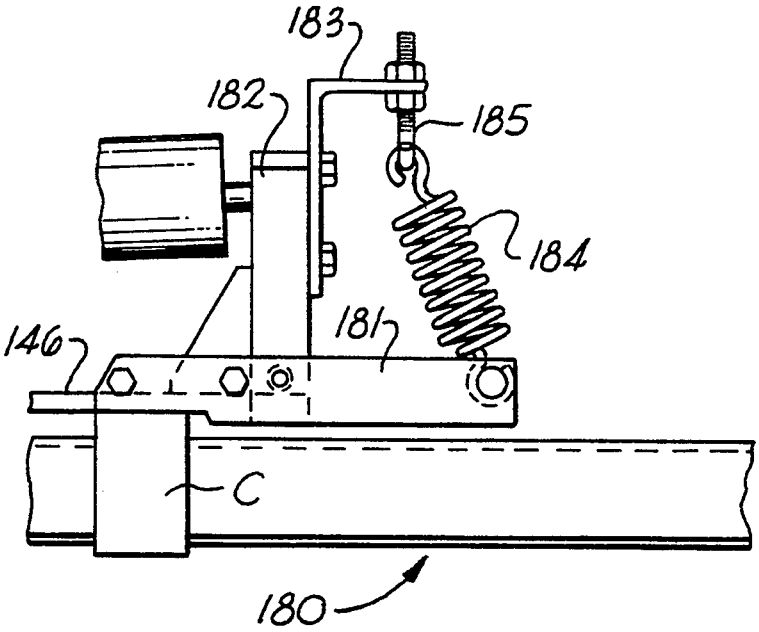
FIG. 11 is a partial illustration of apparatus as shown in FIG. 5, illustrating a further preferred embodiment of the present invention.

Unit 24 may also preferably be equipped as illustrated in FIG. 11 having a means for incorporating a spring bias thereon. Unit 24 is secured to the tenter by a clamp assembly C. A bias assembly frame generally 180 is secured to clamp assembly C. Bias assembly 180 includes a horizontal support member 181. A vertical support member 182 is secured to base 146, extending above a pivot point 147, with a mounting bracket 183 secured thereto and extending outwardly therefrom. A spring 184 is secured at one end to horizontal support 181 and at an opposite end to an adjustment bolt 185 which is, in turn, secured to mounting bracket 183. Adjustment bolt 185 can be adjusted to impart tension on spring 184, thus applying a force on vertical member 182 which provides an upward force on an opposite end of base 146. Such upward force reduces the weight of the pin roll at the nip point, and assists unit 24 in upward pivot in the event a thick web is processed, or a thick seam, or the like passes beneath unit 24.

Operation of the apparatus according to the present invention will now be described. A web 26, such as a fabric, is fed to an entrance end of a tenter frame (not shown) where for purposes of operation within the tenter, both edges or selvages 28 of fabric 26 are pinned in conventional fashion by conveyor pins 34. Conveyors 32 are adjusted laterally to a spacing that is proper for the particular treatment process and/or fabric being processed. Fabric 26 is then moved through the tenter while so pinned. At or adjacent the exit end of the tenter, and after the particular process has been accomplished, the fabric must be removed from pins 34 and handled for further processing. For example, for many fabrics, it is desirable to trim off the selvages 28 of the fabric to remove the holes produced by pins 34 and to wind the fabric into a proper roll or feed same to another machine. In those instances where trimming is not necessary or desirable, the fabric is removed from pins 34 and wound up or fed to another processing machine.

According to the present invention, the moving web 26 is pinned by pins 38 carried on roll 36 before it becomes disengaged from conveyor pins 34, and inside of the line of pins 34 (toward a center of fabric 26). The removal unit of the present invention thus takes control of fabric 26 before release from the tenter. Further, by pins 38 engaging fabric 26 on an inside of tenter pins 34, any unpinned, necked-in areas will not normally remain on conveyors 30 as occurs in the prior art.

Fabric 26, now pinned by removal pins 38, begins an upward movement, following the curvature of roll 36, and an underside or opposite side of fabric 26 is engaged by brush 44 which assists in forcing fabric 26 further onto removal pins 38. As roll 36 rotates, fabric 26 moves around housing 40, contacting housing surfaces 42 on opposite sides of slot 41, and is normally directed (while still on pins 38 and therefore still controlled) between cutting blades 61, 62 where fabric 26 is cut just inside the row of pins 38 with respect to a center of fabric 26. The main body of fabric 26 then proceeds along a path indicated in FIG. 5 as around a guide roll 54 which may be driven or an idler and onto further processing.

The trimmed selvage of fabric 26 remaining on pins 38 constitutes waste. Since fabric 26 remains under control at trimming, the trimming operation is quite precise, thus resulting in significant economy where ¼ inch of fabric width is of great significance. The trimming operation is preferably accomplished by two precisely adjusted cutting discs as noted above, though other cutting means may be employed.

Waste 28 trimmed from fabric 26 continues to move around housing 40, making contact with the circumferential surfaces 42 of housing 40 on opposite sides of slot 41. Due to the eccentricity of roll 36 with respect to housing 40, pins 38 move relatively inwardly with respect to housing 40 and since trimmed fabric 28 engages housing surfaces 42, pins 38 gradually move out of contact with trim 28 until trim 28 becomes unpinned from pins 38. Such occurs generally atop housing 40 as viewed in FIG. 5. Released waste selvage 28 then accumulates on housing 40 and is removed by any convenient means. An end of trim 28 of fabric 26 is shown in FIG. 5 entering a suction trumpet 29 and is transferred away from the area thereby for collection, discarding or the like.

When it is not necessary or desirable to trim fabric 26, cylinder 50 is actuated to rotate housing 40 and cutting means 60 upwardly about shaft 37. A new fabric path is then instituted which by-passes the trimming unit. Fabric 26 then is removed from the tenter in the same fashion and moves directly to guide roll 54. Likewise when base 46 is equipped with a bias assembly 180 as illustrated in FIG. 11, removal unit 24 is spring loaded to assist in upward pivotal movement as described above.

While the invention has been described with regard to the embodiments illustrated hereinabove, it will be understood that variations can be made in the structures of the elements described without departing from the invention as delineated in the claims appended hereto.

What is claimed is:

1. A tenter frame for treating web material such as woven or knit fabric, film or the like comprising:

a) a pair of endless loop elements having tenter pins associated therewith, said elements being located opposite each other for pinning and transporting a web through said frame;

b) a guide roll mounted adjacent an exit end of said frame, disposed adjacent each said endless loop element, each of said guide rolls having a plurality of pins extending outwardly therefrom and being located for pinning engagement with said web inside said tenter pins and while said web remains on said tenter pins;

c) cutting means arranged with respect to each of said guide rolls for cutting said web while said web is pinned on said guide roll pins inside said guide roll pins, leaving a pinned web edge portion; and d) means for guiding said trimmed web material about a portion of the periphery of each guide roll and automatically separating said web material from said guide rolls.

2. A tenter frame as set forth in claim 1, wherein each of said guide rolls is disposed within a housing, said housing having a surface for guiding said web material and defining an annular opening through which said pins on said pinned guide roll extend, said guide rolls being mounted eccentric to said housings in such a manner that said roll pins extend beyond the surface of said housings about a portion of said periphery of said guide rolls only.

3. A tenter frame as set forth in claim 2, further comprising means for removing said trimmed edges of said web material from said rolls after said trimmed edges are removed from said roll pins.

4. A tenter frame as set forth in claim 1, wherein each of said guide rolls is supported in bearings for free rotation by said web material.

5. A tenter frame as set forth in claim 2, wherein each of said guide rolls, said housings and said cutting means are supported on a pivoted support surface.

6. A tenter frame as set forth in claim 4, wherein said means for removing said trimmed edges includes a suction waste collection means.

7. A tenter frame as set forth in claim 1, wherein said cutting means comprises two overlapping rotating discs, one of said discs being driven.

8. A tenter frame as set forth in claim 7, wherein said driven disc is disposed within a housing and the other of said cutting discs is supported outside of said housing for rotation, one of said discs further being canted to define a predetermined gap therebetween along a portion of the overlap.

* * * * *